US009369801B2

(12) United States Patent
Carlsson et al.

(10) Patent No.: US 9,369,801 B2
(45) Date of Patent: Jun. 14, 2016

(54) WIRELESS SPEAKER SYSTEM WITH NOISE CANCELATION

(71) Applicant: SONY CORPORATION, Tokyo (JP)

(72) Inventors: Gregory Peter Carlsson, Santee, CA (US); Frederick J. Zustak, Poway, CA (US); Steven Martin Richman, San Diego, CA (US); James R. Milne, Ramona, CA (US)

(73) Assignee: Sony Corporation, Tokyo (JP)

( * ) Notice: Subject to any disclaimer, the term of this patent is extended or adjusted under 35 U.S.C. 154(b) by 104 days.

(21) Appl. No.: 14/163,089

(22) Filed: Jan. 24, 2014

(65) Prior Publication Data

US 2015/0215699 A1 Jul. 30, 2015

(51) Int. Cl.

| | |
|---|---|
| ***G10K 11/16*** | (2006.01) |
| ***H04R 3/02*** | (2006.01) |
| *H04R 5/00* | (2006.01) |
| *H04S 7/00* | (2006.01) |

(52) U.S. Cl.

CPC ..... *H04R 3/02* (2013.01); *H04R 2227/001* (2013.01); *H04R 2410/05* (2013.01); *H04R 2420/07* (2013.01); *H04S 7/302* (2013.01)

(58) Field of Classification Search

CPC ..... H04R 3/002; H04R 2420/07; H04R 2410/05; H04R 2227/005; H04R 1/1083; H04R 2227/003; H04R 27/00; H04M 2250/02; H04M 2250/06; H04W 16/28; H04W 28/048; H04W 88/06; H04S 3/00; H04S 7/30; H04S 2420/01; H04S 7/302; H04S 7/40; G10K 11/1786; G10K 15/02; G10K 2210/111; G10K 2210/12; G10K 2210/3215

USPC ..... 381/71.1, 111, 17, 71.8, 80, 94.1, 94.2, 381/98

See application file for complete search history.

(56) References Cited

U.S. PATENT DOCUMENTS

| | | | |
|---|---|---|---|
| 6,008,777 | A | 12/1999 | Yiu |
| 7,085,387 | B1 | 8/2006 | Metcalf |
| 7,191,023 | B2 | 3/2007 | Williams |
| 7,689,613 | B2 | 3/2010 | Candelore |
| 7,792,311 | B1 | 9/2010 | Holmgren et al. |
| 7,822,835 | B2 | 10/2010 | Atkinson et al. |
| 7,853,022 | B2 | 12/2010 | Thompson et al. |
| 8,068,095 | B2 | 11/2011 | Pryor |
| 8,077,873 | B2 | 12/2011 | Shridhar et al. |
| 8,079,055 | B2 | 12/2011 | Hardacker et al. |

(Continued)

FOREIGN PATENT DOCUMENTS

| | | | |
|---|---|---|---|
| JP | 2011004077 | A | 1/2011 |
| WO | 2009002292 | A1 | 12/2008 |
| WO | 2012164444 | A1 | 12/2012 |

OTHER PUBLICATIONS

Hardacker et al. "Personalized Quiet Zone" May 13, 2009. http://ip.com/IPCOM/000183027.

(Continued)

*Primary Examiner* — Paul S Kim
*Assistant Examiner* — Norman Yu
(74) *Attorney, Agent, or Firm* — John L. Rogitz

(57) ABSTRACT

A networked-speaker system which includes noise cancelling for active suppression of unwanted sounds. Feed-forward or feed-back cancelation can be used as appropriate for the location of the microphone sensing the noise.

20 Claims, 3 Drawing Sheets

(56) References Cited

U.S. PATENT DOCUMENTS 8,179,755 B2 5/2012 Harris
8,199,941 B2 6/2012 Hudson et al.
8,296,808 B2 10/2012 Hardacker et al.
8,320,674 B2 11/2012 Guillou et al.
8,436,758 B2 5/2013 McLaughlin et al.
8,437,432 B2 5/2013 McLaughlin et al.
8,438,589 B2 5/2013 Candelore
8,509,463 B2 8/2013 Goh et al.
8,553,898 B2 10/2013 Raftery
8,614,668 B2 12/2013 Pryor
8,621,498 B2 12/2013 Candelore
8,629,942 B2 1/2014 Candelore
8,677,224 B2 3/2014 McLaughlin et al.
8,760,334 B2 6/2014 McLaughlin et al.
8,811,630 B2 * 8/2014 Burlingame ..... H03G 5/005 381/103
9,054,790 B2 6/2015 McLaughlin et al.
9,161,111 B2 10/2015 Yuan et al.
2001/0037499 A1 11/2001 Turock et al.
2002/0054206 A1 5/2002 Allen
2002/0122137 A1 9/2002 Chen et al.
2002/0136414 A1 9/2002 Jordan et al.
2003/0046685 A1 3/2003 Srinivasan et al.
2003/0107677 A1 6/2003 Lu et al.
2003/0210337 A1 11/2003 Hall
2004/0030425 A1 2/2004 Yeakel et al.
2004/0068752 A1 4/2004 Parker
2004/0196140 A1 10/2004 Sid
2004/0264704 A1 12/2004 Huin et al.
2005/0024324 A1 2/2005 Tomasi et al.
2005/0125820 A1 6/2005 Nelson et al.
2005/0177256 A1 8/2005 Shintani et al.
2006/0106620 A1 5/2006 Thompson et al.
2006/0195866 A1 8/2006 Thukral
2006/0285697 A1 12/2006 Nishikawa et al.
2007/0297519 A1 12/2007 Thompson et al.
2008/0002836 A1 1/2008 Moeller et al.
2008/0025535 A1 1/2008 Rajapakse
2008/0141316 A1 6/2008 Igoe et al.
2008/0175397 A1 7/2008 Holman
2008/0207115 A1 8/2008 Lee et al.
2008/0259222 A1 10/2008 Hardacker et al.
2008/0279307 A1 11/2008 Gaffney et al.
2008/0279453 A1 11/2008 Candelore
2008/0304677 A1 * 12/2008 Abolfathi ..... G10K 11/1788 381/71.1
2008/0313670 A1 12/2008 Ho et al.
2009/0037951 A1 2/2009 Candelore et al.
2009/0041418 A1 2/2009 Candelore et al.
2009/0060204 A1 3/2009 Reams et al.
2009/0150569 A1 6/2009 Kumar et al.
2009/0172744 A1 7/2009 Rothschild
2009/0313675 A1 12/2009 Howarter et al.
2010/0220864 A1 9/2010 Martin
2010/0260348 A1 10/2010 Bhow et al.
2011/0091055 A1 4/2011 LeBlanc
2011/0157467 A1 6/2011 McRae
2011/0270428 A1 11/2011 Tam
2012/0011550 A1 1/2012 Holland
2012/0014524 A1 1/2012 Vafiadis
2012/0058727 A1 3/2012 Cook et al.
2012/0069868 A1 3/2012 McLaughlin et al.
2012/0114151 A1 * 5/2012 Nguyen ..... G06T 7/0065 381/303
2012/0117502 A1 5/2012 Nguyen et al.
2012/0120874 A1 5/2012 McLaughlin et al.
2012/0148075 A1 6/2012 Goh et al.
2012/0158972 A1 6/2012 Gammill et al.
2012/0174155 A1 7/2012 Mowrey et al.
2012/0220224 A1 8/2012 Walker
2012/0254931 A1 10/2012 Oztaskent et al.
2012/0291072 A1 11/2012 Maddison et al.
2012/0320278 A1 12/2012 Yoshitani et al.
2013/0003822 A1 1/2013 Margulis
2013/0039514 A1 2/2013 Knowles et al.
2013/0042292 A1 2/2013 Buff et al.
2013/0052997 A1 2/2013 Killick et al.
2013/0055323 A1 2/2013 Venkitaraman et al.
2013/0109371 A1 5/2013 Brogan et al.
2013/0156212 A1 * 6/2013 Bjelosevic ..... G10K 11/16 381/71.1
2013/0191753 A1 7/2013 Sugiyama et al.
2013/0205319 A1 8/2013 Sinha et al.
2013/0210353 A1 8/2013 Ling et al.
2013/0223279 A1 8/2013 Tinnakornsrisuphap et al.
2013/0229577 A1 9/2013 McRae
2013/0237156 A1 9/2013 Jung et al.
2013/0238538 A1 9/2013 Cook et al.
2013/0249791 A1 9/2013 Pryor
2013/0272535 A1 10/2013 Yuan et al.
2013/0298179 A1 11/2013 Baum et al.
2013/0305152 A1 11/2013 Griffiths et al.
2013/0309971 A1 11/2013 Kiukkonen et al.
2013/0310064 A1 11/2013 Brachet et al.
2013/0312018 A1 11/2013 Elliott et al.
2013/0317905 A1 11/2013 Warner et al.
2013/0321268 A1 12/2013 Tuck et al.
2013/0325396 A1 12/2013 Yuen et al.
2013/0325954 A1 12/2013 Cupala et al.
2013/0326552 A1 12/2013 Adams
2013/0332957 A1 12/2013 DeWeese et al.
2014/0003623 A1 1/2014 Lang
2014/0003625 A1 1/2014 Sheen et al.
2014/0004934 A1 1/2014 Peterson et al.
2014/0009476 A1 1/2014 Venkitaraman et al.
2014/0011448 A1 1/2014 Yang
2014/0026193 A1 1/2014 Saxman et al.
2014/0064492 A1 3/2014 Lakkundi et al.
2014/0219483 A1 8/2014 Hong
2015/0201295 A1 7/2015 Lau et al.
2015/0208187 A1 7/2015 Carlsson et al.
2015/0341737 A1 11/2015 Kallai et al.
2015/0350804 A1 12/2015 Crockett et al.
2015/0358707 A1 12/2015 Saijo et al.

OTHER PUBLICATIONS

"Method and System for Discovery and Configuration of Wi-Fi Speakers", http://ip.com/IPCOM/000220175; Dec. 31, 2008.
Frieder Ganz, Payam Barnaghi, Francois Carrez, Klaus Moessner, "Context-Aware Management for Sensor Networks", University of Surrey, Guildford, UK publication, 2011.
Sokratis Kartakis, Margherita Antona, Constantine Stephandis, "Control Smart Homes Easily with Simple Touch", University of Crete, Crete, GR, 2011.
Gregory Peter Carlsson, Steven Martin Richman, James R. Milne, "Distributed Wireless Speakers System", file history of related pending U.S. Appl. No. 14/158,396, filed Jan. 17, 2014.
Gregory Peter Carlsson, Steven Martin Richman, James R. Milne, "Distributed Wireless Speaker System with Automatic Configuration Determination When New Speakers Are Added", file history of related pending U.S. Appl. No. 14/159,155, filed Jan. 20, 2014.
James R. Milne, Gregory Peter Carlsson, Steven Martin Richman, Frederick J. Zustak, "Audio Speaker System with Virtual Music Performance", File History of related pending U.S. Appl. No. 14/163,415, filed Jan. 24, 2014.
Gregory Peter Carlsson, Frederick J. Zustak, Steven Martin Richman, James R. Milne, 'Wireless Speaker System with Distributed Low (Bass) Frequency, file history of related pending U.S. Appl. No. 14/163,213, filed Jan. 24, 2014.
Gregory Peter Carlsson, James R. Milne, Steven Martin Richman, Frederick J. Zustak, 'Distributed Wireless Speaker System with Light Show, file history of related pending U.S. Appl. No. 14/163,542, filed Jan. 24, 2014.
Gregory Peter Carlsson, Keith Resch, Oscar Manuel Vega, "Networked Speaker System with Follow Me", file history of related allowed U.S. Appl. No. 14/199,137, filed Mar. 6, 2014.
Robert W. Reams, "N-Channel Rendering; Workable 3-D Audio for 4kTV", AES 135, New York City, 2013.
James R. Milne, Gregory Peter Carlsson, Steven Martin Richman, Frederick J. Zustak "Audio Speaker System With Virtual Music Performance", related U.S. Appl. No. 14/163,415, Final Office Action dated Feb. 25, 2016.

(56) References Cited

OTHER PUBLICATIONS

Gregory Peter Carlsson, Frederick J. Zustak, Steven Martin Richman, James R. Milne, "Wireless Speaker System with Distributed Low (Bass) Frequency", related U.S. Appl. No. 14/163,213. Final Office Action dated Feb. 23, 2016.

Gregory Peter Carlsson, James R. Milne, Steven Martin Richman, Frederick J. Zustak. "Distributed Wireless Speaker System with Light Show", related U.S. Appl. No. 14/163,542, Non-Final Office Action dated Feb. 24, 2016.

Gregory Peter Carlsson, Keith Resch, Oscar Manuel Vega, "Networked Speaker System with Follow Me", File history of related U.S. Appl. No. 14/974,413, filed Dec. 18, 2015.

James R. Milne, Gregory Carlsson, "Centralized Wireless Speaker System", file history of related U.S. Appl. No. 15/019,111, filed Feb. 9, 2016.

James R. Milne, Gregory Carlsson, "Distributed Wireless Speaker System", file history of related U.S. Appl. No. 15/044,920, filed Feb. 16, 2016.

James R. Milne, Gregory Carlsson, Steven Richman, Frederick Zustak, "Wireless Speaker System", file history of related U.S. Appl. No. 15/044,981, filed Feb. 16, 2016.

* cited by examiner

WIRELESS SPEAKER SYSTEM WITH NOISE CANCELATION

FIELD OF THE INVENTION

The present application relates generally to wireless speaker systems with noise cancelation.

BACKGROUND OF THE INVENTION

People who enjoy high quality sound, for example in home entertainment systems, prefer to use multiple speakers for providing stereo, surround sound, and other high fidelity sound. As understood herein, unwanted external noises from other rooms in the home or from outside the home can interfere with the entertainment experience.

SUMMARY OF THE INVENTION

Present principles provide a networked speaker system that uses networked speakers and microphones to implement feed-forward and/or feed-back noise cancelling technologies on a relatively larger scale. A signal from a microphone outside a room in which multiple networked speakers are located can be used in conjunction with a microphone within the room to improve the systems performance. The network connections of the speakers enable distribution of the components (microphones, loudspeakers, processing) of a noise cancelling system over a relatively large area.

Accordingly, a device includes at least one computer readable storage medium bearing instructions executable by a processor, and at least one processor configured for accessing the computer readable storage medium to execute the instructions to configure the processor for receiving a noise signal from at least one microphone. The processor when executing the instructions is also configured for receiving room information indicating configuration of a room in which multiple speakers are located, receiving speaker location information indicating a location in the room of at least one speaker, and receiving listener location information indicating a target listener location. Based on at least the room information and listener location information, the processor when executing the instructions is configured for determining an amplitude and phase, at the target listener location, of noise represented by the noise signal at the target listener location. The processor when executing the instructions is also configured for, based on the room information, speaker location information, listener location information, and determination of the amplitude and phase of the noise at the target listener location, causing the at least one speaker to emit a noise cancelation signal calculated to have an amplitude equal to the amplitude of the noise at the target listener location and a phase opposite to the phase of the noise at the target listener location.

In some embodiments the microphone is external to the room. In other embodiments the microphone is at the target listener location. In other embodiments the microphone is not at the target listener location.

In example implementations the processor when executing the instructions may be configured for receiving microphone information indicating a location of the microphone, and based on at least the room information, microphone information, and listener location information, determining an amplitude and phase of the noise at the target listener location.

The processor when executing the instructions may receive the room information indicating configuration of a room in which multiple speakers are located from a user interface (UI). Likewise, the processor when executing the instructions can receive the speaker location information indicating a location in the room of at least one speaker from a user interface (UI). Also, the processor when executing the instructions may receive the listener location information indicating a target listener location from a user interface (UI).

In another aspect, a method includes receiving a noise signal from at least one microphone, and receiving from a user interface (UI) room information indicating configuration of a room in which multiple speakers are located. The method further includes receiving from a UI speaker location information indicating a location in the room of at least one speaker, receiving from a UI listener location information indicating a target listener location, and based on at least the room information and listener location information, determining noise characteristics at the target listener location. Based on the room information, speaker location information, listener location information, and determination of the noise characteristics at the target listener location, the method causes the at least one speaker to emit a noise cancelation signal calculated to substantially cancel the noise characteristics.

In another aspect, a system includes at least one computer readable storage medium bearing instructions executable by a processor which is configured for accessing the computer readable storage medium to execute the instructions to configure the processor for accessing a networked audio speaker system. The processor when accessing the instructions is further configured for receiving at least a noise signal from a microphone, and configuring the networked audio speaker system for cancelling noise for active suppression of unwanted sounds represented by the noise signal.

The details of the present application, both as to its structure and operation, can be best understood in reference to the accompanying drawings, in which like reference numerals refer to like parts, and in which:

DETAILED DESCRIPTION OF THE PREFERRED EMBODIMENT

Figure 1:
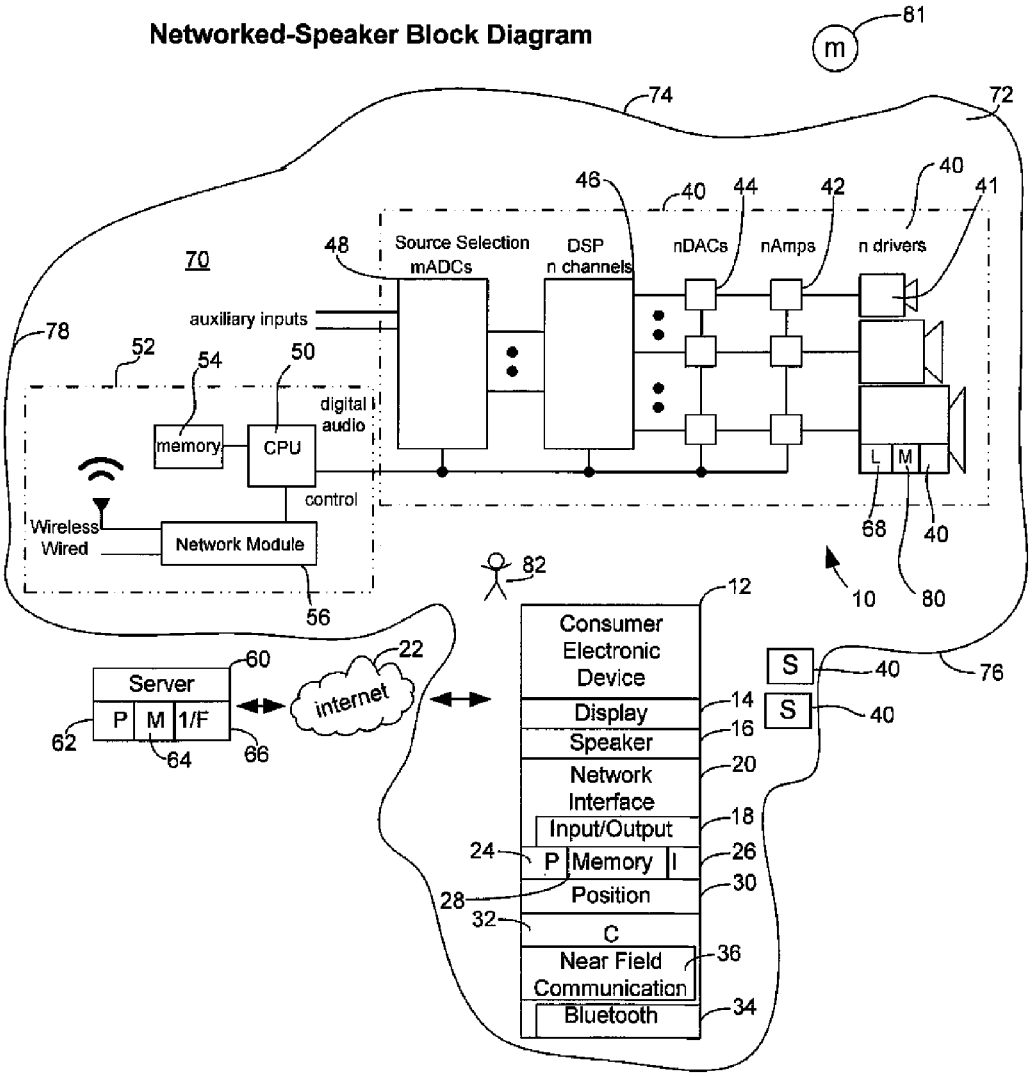
FIG. 1 is a block diagram of an example system including an example in accordance with present principles.

This disclosure relates generally to computer ecosystems including aspects of multiple audio speaker ecosystems. A system herein may include server and client components, connected over a network such that data may be exchanged between the client and server components. The client components may include one or more computing devices that have audio speakers including audio speaker assemblies per se but also including speaker-bearing devices such as portable televisions (e.g. smart TVs, Internet-enabled TVs), portable computers such as laptops and tablet computers, and other mobile devices including smart phones and additional examples discussed below. These client devices may operate with a variety of operating environments. For example, some of the client computers may employ, as examples, operating systems from Microsoft, or a Unix operating system, or operating systems produced by Apple Computer or Google. These operating environments may be used to execute one or more browsing programs, such as a browser made by Microsoft or Google or Mozilla or other browser program that can access web applications hosted by the Internet servers discussed below.

Servers may include one or more processors executing instructions that configure the servers to receive and transmit data over a network such as the Internet. Or, a client and server can be connected over a local intranet or a virtual private network.

Information may be exchanged over a network between the clients and servers. To this end and for security, servers and/or clients can include firewalls, load balancers, temporary storages, and proxies, and other network infrastructure for reliability and security. One or more servers may form an apparatus that implement methods of providing a secure community such as an online social website to network members.

As used herein, instructions refer to computer-implemented steps for processing information in the system. Instructions can be implemented in software, firmware or hardware and include any type of programmed step undertaken by components of the system.

A processor may be any conventional general purpose single- or multi-chip processor that can execute logic by means of various lines such as address lines, data lines, and control lines and registers and shift registers. A processor may be implemented by a digital signal processor (DSP), for example.

Software modules described by way of the flow charts and user interfaces herein can include various sub-routines, procedures, etc. Without limiting the disclosure, logic stated to be executed by a particular module can be redistributed to other software modules and/or combined together in a single module and/or made available in a shareable library.

Present principles described herein can be implemented as hardware, software, firmware, or combinations thereof; hence, illustrative components, blocks, modules, circuits, and steps are set forth in terms of their functionality.

Further to what has been alluded to above, logical blocks, modules, and circuits described below can be implemented or performed with a general purpose processor, a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can be implemented by a controller or state machine or a combination of computing devices.

The functions and methods described below, when implemented in software, can be written in an appropriate language such as but not limited to C# or C++, and can be stored on or transmitted through a computer-readable storage medium such as a random access memory (RAM), read-only memory (ROM), electrically erasable programmable read-only memory (EEPROM), compact disk read-only memory (CD-ROM) or other optical disk storage such as digital versatile disc (DVD), magnetic disk storage or other magnetic storage devices including removable thumb drives, etc. A connection may establish a computer-readable medium. Such connections can include, as examples, hard-wired cables including fiber optics and coaxial wires and digital subscriber line (DSL) and twisted pair wires. Such connections may include wireless communication connections including infrared and radio.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

Now specifically referring to FIG. 1, an example system 10 is shown, which may include one or more of the example devices mentioned above and described further below in accordance with present principles. The first of the example devices included in the system 10 is an example consumer electronics (CE) device 12. The CE device 12 may be, e.g., a computerized Internet enabled ("smart") telephone, a tablet computer, a notebook computer, a wearable computerized device such as e.g. computerized Internet-enabled watch, a computerized Internet-enabled bracelet, other computerized Internet-enabled devices, a computerized Internet-enabled music player, computerized Internet-enabled head phones, a computerized Internet-enabled implantable device such as an implantable skin device, etc., and even e.g. a computerized Internet-enabled television (TV). Regardless, it is to be understood that the CE device 12 is configured to undertake present principles (e.g. communicate with other devices to undertake present principles, execute the logic described herein, and perform any other functions and/or operations described herein).

Accordingly, to undertake such principles the CE device 12 can be established by some or all of the components shown in FIG. 1. For example, the CE device 12 can include one or more touch-enabled displays 14, one or more speakers 16 for outputting audio in accordance with present principles, and at least one additional input device 18 such as e.g. an audio receiver/microphone for e.g. entering audible commands to the CE device 12 to control the CE device 12. The example CE device 12 may also include one or more network interfaces 20 for communication over at least one network 22 such as the Internet, an WAN, an LAN, etc. under control of one or more processors 24. It is to be understood that the processor 24 controls the CE device 12 to undertake present principles, including the other elements of the CE device 12 described herein such as e.g. controlling the display 14 to present images thereon and receiving input therefrom. Furthermore, note the network interface 20 may be, e.g., a wired or wireless modem or router, or other appropriate interface such as, e.g., a wireless telephony transceiver, Wi-Fi transceiver, etc.

In addition to the foregoing, the CE device 12 may also include one or more input ports 26 such as, e.g., a USB port to physically connect (e.g. using a wired connection) to another CE device and/or a headphone port to connect headphones to the CE device 12 for presentation of audio from the CE device 12 to a user through the headphones. The CE device 12 may further include one or more tangible computer readable storage medium or memory 28 such as disk-based or solid state storage. Also in some embodiments, the CE device 12 can include a position or location receiver such as but not limited to a GPS receiver and/or altimeter 30 that is configured to e.g. receive geographic position information from at least one satellite and provide the information to the processor 24 and/or determine an altitude at which the CE device 12 is disposed in conjunction with the processor 24. However, it is to be understood that that another suitable position receiver other than a GPS receiver and/or altimeter may be used in accordance with present principles to e.g. determine the location of the CE device 12 in e.g. all three dimensions.

Continuing the description of the CE device 12, in some embodiments the CE device 12 may include one or more cameras 32 that may be, e.g., a thermal imaging camera, a digital camera such as a webcam, and/or a camera integrated into the CE device 12 and controllable by the processor 24 to gather pictures/images and/or video in accordance with present principles. Also included on the CE device 12 may be a Bluetooth transceiver 34 and other Near Field Communication (NFC) element 36 for communication with other devices using Bluetooth and/or NFC technology, respectively. An example NFC element can be a radio frequency identification (RFID) element.

Further still, the CE device 12 may include one or more motion sensors (e.g., an accelerometer, gyroscope, cyclometer, magnetic sensor, infrared (IR) motion sensors such as passive IR sensors, an optical sensor, a speed and/or cadence sensor, a gesture sensor (e.g. for sensing gesture command), etc.) providing input to the processor 24. The CE device 12 may include still other sensors such as e.g. one or more climate sensors (e.g. barometers, humidity sensors, wind sensors, light sensors, temperature sensors, etc.) and/or one or more biometric sensors providing input to the processor 24. In addition to the foregoing, it is noted that in some embodiments the CE device 12 may also include a kinetic energy harvester to e.g. charge a battery (not shown) powering the CE device 12.

In some examples the CE device 12 is used to control multiple ("n", wherein "n" is an integer greater than one) speakers 40, each of which receives signals from a respective amplifier 42 over wired and/or wireless links to transduce the signal into sound. Each amplifier 42 may receive over wired and/or wireless links an analog signal that has been converted from a digital signal by a respective standalone or integral (with the amplifier) digital to analog converter (DAC) 44. The DACs 44 may receive, over respective wired and/or wireless channels, digital signals from a digital signal processor (DSP) 46 or other processing circuit. The DSP 46 may receive source selection signals over wired and/or wireless links from plural analog to digital converters (ADC) 48, which may in turn receive appropriate auxiliary signals and, from a control processor 50 of a control device 52, digital audio signals over wired and/or wireless links. The control processor 50 may access a computer memory 54 such as any of those described above and may also access a network module 56 to permit wired and/or wireless communication with, e.g., the Internet. As shown in FIG. 1, the control processor 50 may also communicate with each of the ADCs 48, DSP 46, DACs 44, and amplifiers 42 over wired and/or wireless links. The control device 52, while being shown separately from the CE device 12, may be implemented by the CE device 12. In some embodiments the CE device 12 is the control device and the CPU 50 and memory 54 are distributed in each individual speaker as individual speaker processing units. In any case, each speaker 40 can be separately addressed over a network from the other speakers.

More particularly, in some embodiments, each speaker 40 may be associated with a respective network address such as but not limited to a respective media access control (MAC) address. Thus, each speaker may be separately addressed over a network such as the Internet. Wired and/or wireless communication links may be established between the speakers 40/CPU 50, CE device 12, and server 60, with the CE device 12 and/or server 60 being thus able to address individual speakers, in some examples through the CPU 50 and/or through the DSP 46 and/or through individual processing units associated with each individual speaker 40, as may be mounted integrally in the same housing as each individual speaker 40. Thus, as alluded to above, the CPU 50 may be distributed in individual processing units in each speaker 40.

The CE device 12 and/or control device 52 (when separate from the CE device 12) and/or individual speaker trains (speaker+amplifier+DAC+DSP, for instance) may communicate over wired and/or wireless links with the Internet 22 and through the Internet 22 with one or more network servers 60. Only a single server 60 is shown in FIG. 1. A server 60 may include at least one processor 62, at least one tangible computer readable storage medium 64 such as disk-based or solid state storage, and at least one network interface 66 that, under control of the processor 62, allows for communication with the other devices of FIG. 1 over the network 22, and indeed may facilitate communication between servers and client devices in accordance with present principles. Note that the network interface 66 may be, e.g., a wired or wireless modem or router, Wi-Fi transceiver, or other appropriate interface such as, e.g., a wireless telephony transceiver.

Accordingly, in some embodiments the server 60 may be an Internet server, may include and perform "cloud" functions such that the devices of the system 10 may access a "cloud" environment via the server 60 in example embodiments. In a specific example, the server 60 downloads a software application to the CE device 12 for control of the speakers 40 according to logic below. The CE device 12 in turn can receive certain information from the speakers 40, such as their GPS location, and/or the CE device 12 can receive input from the user, e.g., indicating the locations of the speakers 40 as further disclosed below. Based on these inputs at least in part, the CE device 12 may execute the speaker optimization logic discussed below, or it may upload the inputs to a cloud server 60 for processing of the optimization algorithms and return of optimization outputs to the CE device 12 for presentation thereof on the CE device 12, and/or the cloud server 60 may establish speaker configurations automatically by directly communicating with the speakers 40 via their respective addresses, in some cases through the CE device 12. Note that if desired, each speaker 40 may include a respective one or more lamps 68 that can be illuminated on the speaker.

Typically, the speakers 40 are disposed in an enclosure 70 such as a room, e.g., a living room. Note that each speaker or a group of speakers may themselves be located in a speaker enclosure with the room enclosure 70. For purposes of disclosure, the enclosure 70 has (with respect to the example orientation of the speakers shown in FIG. 1) a front wall 72, left and right side walls 74, 76, and a rear wall 78. One or more listeners 82 may occupy the enclosure 70 to listen to audio from the speakers 40. One or microphones 80 may be arranged in the enclosure for measuring signals representative of sound in the enclosure 70, sending those signals via wired and/or wireless links to the CPU 50 and/or the CE device 12 and/or the server 60. In the non-limiting example shown, each speaker 40 supports a microphone 80, it being understood that the one or more microphones may be arranged elsewhere in the system if desired. For example, at least one microphone assembly 81 is located outside the enclosure 70 for noise cancelation purposes. The assembly 81 includes a microphone and if desired a processor and a network interface such as a wireless transceiver to communicate with one or more of the CE device 12, server 60, and CPU 50 either directly or through the Internet.

Disclosure below may refer to establishing noise cancelation waves or other similar determinations. It is to be understood that such determinations may be made using sonic wave calculations known in the art, in which the acoustic waves frequencies (and their harmonics) from each speaker, given its frequency response assignation, are computationally modeled in the enclosure 70 and the locations of constructive and destructive wave interference determined based on where the speaker is and where the walls 72-78 are. As mentioned above, the computations may be executed, e.g., by the CE device 12 and/or by the cloud server 60, with results of the computations being returned to the CE device 12 for presentation thereof and/or used to automatically establish parameters of the speakers.

As an example, a speaker may emit a band of frequencies between 20 Hz and 30 Hz, and frequencies (with their harmonics) of 20 Hz, 40 Hz, and 60 Hz may be modeled to propagate in the enclosure 70 with constructive and destructive interference locations noted and recorded. Other frequencies also can be modeled, e.g., 20-200 Hz frequencies, with harmonics if desired. The wave interference patterns of other speakers based on the modeled expected frequency response assignations and the locations in the enclosure 70 of those other speakers may be similarly computationally modeled together to render an acoustic model for a particular speaker system physical layout in the enclosure 70 with a particular speaker frequency response assignation. In some embodiments, reflection of sound waves from one or more of the walls 72-78 may be accounted for in determining wave interference. In other embodiments reflection of sound waves from one or more of the walls 72-78 may not be accounted for in determining wave interference. The acoustic model based on wave interference computations may furthermore account for particular speaker parameters such as but not limited to equalization (EQ). The parameters may also include delays, i.e., sound track delays between speakers, which result in respective wave propagation delays relative to the waves from other speakers, which delays may also be accounted for in the modeling. A sound track delay refers to the temporal delay between emitting, using respective speakers, parallel parts of the same soundtrack, which temporally shifts the waveform pattern of the corresponding speaker. The parameters can also include volume, which defines the amplitude of the waves from a particular speaker and thus the magnitude of constructive and destructive interferences in the waveform. Collectively, a combination of speaker location, frequency response assignation, and parameters may be considered to be a "configuration".

Each variable (speaker location, frequency response assignation, and individual parameters) may then be computationally varied as the other variables remain static to render a different configuration having a different acoustic model for generating noise cancelation acoustic waves. For example, one model may be generated for the speakers of a system being in respective first locations, and then a second model computed by assuming that at least one of the speakers has been moved to a second location different from its first location, and each such computation may be repeated for various frequency response assignations and speaker parameter(s) to render a set of computations for multiple permutations and combinations of speaker location/frequency response assignation/parameter. Similarly, a first model may be generated for speakers of a system having a first set of frequency response assignations, and then a second model may be computed by assuming that at least one of the speakers has been assigned a second frequency band to transmit different from its first frequency response assignation. Yet again, if one speaker location/frequency response assignation combination is evaluated as presenting a poor configuration, the model may introduce, speaker by speaker, a series of incremental delays, reevaluating the acoustic model for each delay increment, until a particular set of delays to render the particular speaker location/frequency response assignation combination acceptable is determined. Acoustic models for any number of speaker location/frequency response assignation/speaker parameter (i.e., for any number of configurations) may be calculated in this way.

Each acoustic model may then be evaluated based at least in part on the locations and/or magnitudes of the constructive and destructive interferences in that model to render one or more of the determinations/recommendations below. The evaluations may be based on heuristically-defined rules. Non-limiting examples of such rules may be that a particular configuration is evaluated as "good" if an assumed noise wave pattern at a target listener location in the enclosure 70 can be canceled, within a threshold decibel reduction if desired, by the speaker configuration. Or, a rule might evaluate a configuration as "good" if it can cancel a threshold number of different noise frequency/phase/amplitude combinations at a target location. Other heuristics may be used.

The location of the walls 72-78 may be input by the user using, e.g., a user interface (UI) in which the user may draw, as with a finger or stylus on a touch screen display 14 of a CE device 12, the walls 72-78 and locations of the speakers 40. Or, the position of the walls may be measured by emitting chirps, including a frequency sweep of chirps, in sequence from each of the speakers 40 as detected by each of the microphones 80 and/or from the microphone 18 of the CE device 12, determining, using the formula distance=speed of sound multiplied by time until an echo is received back, the distance between the emitting microphone and the walls returning the echoes. Note in this embodiment the location of each speaker (inferred to be the same location as the associated microphone) is known as described above. By computationally modeling each measured wall position with the known speaker locations, the contour of the enclosure 70 can be approximately mapped.

Figure 2:
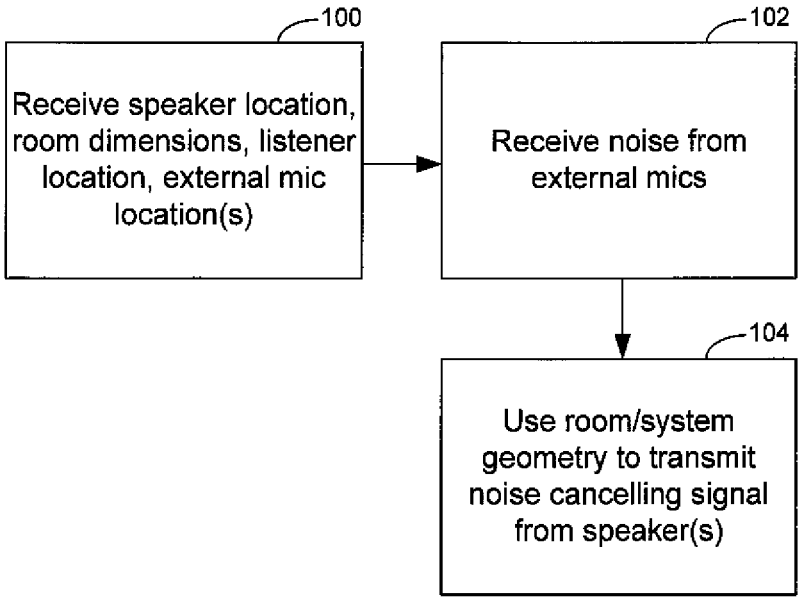
FIGS. 2 and 2A are flow charts of example logic according to present principles.

Now referring to FIG. 2, a flow chart of example logic is shown. The logic shown in FIG. 2 may be executed by one or more of the CPU 50, the CE device 12 processor 24, and the server 60 processor 62. The logic may be executed at application boot time when a user, e.g. by means of the CE device 12, launches a control application.

Of particular focus herein is noise cancelation. Commencing at block 100, a target speaker location is received as, e.g., input by the user via a user interface (UI) such as the example UI in FIG. 3, or by assuming a default location, e.g., X feet directly in front of a speaker array. Room (enclosure 70) dimensions also are received, either by user input (e.g., via the UI of FIG. 3), accessing an electronic map of the enclosure, detecting enclosure walls using test chirps from speakers and receiving echoes using the above-described microphones, etc. When feed-forward cancelation is used, the location of the detecting feed-forward microphone(s) 81 is also received, again from user input or from GPS information from the microphone when it is provided with a GPS receiver and a network interface, etc. When feedback noise cancelation is used, the microphone 81, as will be appreciated by the skilled artisan, is co-located with the listener position, e.g., is mounted on headphones worn by the user.

At block 102, noise signals are received from the noise cancelation microphone, e.g., the microphone 81. A cancelation sound of equal magnitude and frequency but opposite phase to the signal received from the noise-cancelation microphone is generated to occur in this relationship to the noise signal at the target listener location. This may done at block 104 by modeling the noise signal received from the microphone 81 as propagating in a wave from the location of the microphone 81 to the location of the listener. The amplitude, frequency, and phase of the noise at the speaker is thus determined using wave propagation modeling accounting for the acoustic dimensions of the enclosure 70. Then, a cancelation wave is generated from one or more speakers 40 by calculating a wave of the same frequency as the noise wave with an amplitude and phase at the emitting cancelation speaker that will result in the same amplitude as calculated for the noise at the listener location, but of opposite phase to the noise at the location of the listener. The same principles may be applied to feedback systems except that the noise detecting microphone is modeled as being at the same location as the listener.

It is to be understood at this point that the noise cancelation described previously uses acoustic wave propagation analysis.

To determine speaker location, position information may be received from each speaker 40 as sensed by a global positioning satellite (GPS) receiver on the speaker, or as determined using Wi-Fi (via the speaker's MAC address, Wi-Fi signal strength, triangulation, etc. using a Wi-Fi transmitter associated with each speaker location, which may be mounted on the respective speaker) to determine speaker location. Or, the speaker location may be input by the user as discussed further below.

As stated above, each variable of the speaker configuration (location and/or frequency response assignation and/or speaker parameter) may be varied individually and incrementally to establish a noise cancelation signal. If measurement microphones are available to measure the dimensions of the enclosure 70, the user can be through a measurement routine. In one example, the user is guided to cause each individual speaker in the system to emit a test sound ("chirp") that the microphones 80 and/or microphone 18 of the CE device 12 detect and provide representative signals thereof to the processor or processors executing the logic, which, based on the test chirps and echoes thereof, can determine the location of the walls of the enclosure.

Figure 2A:
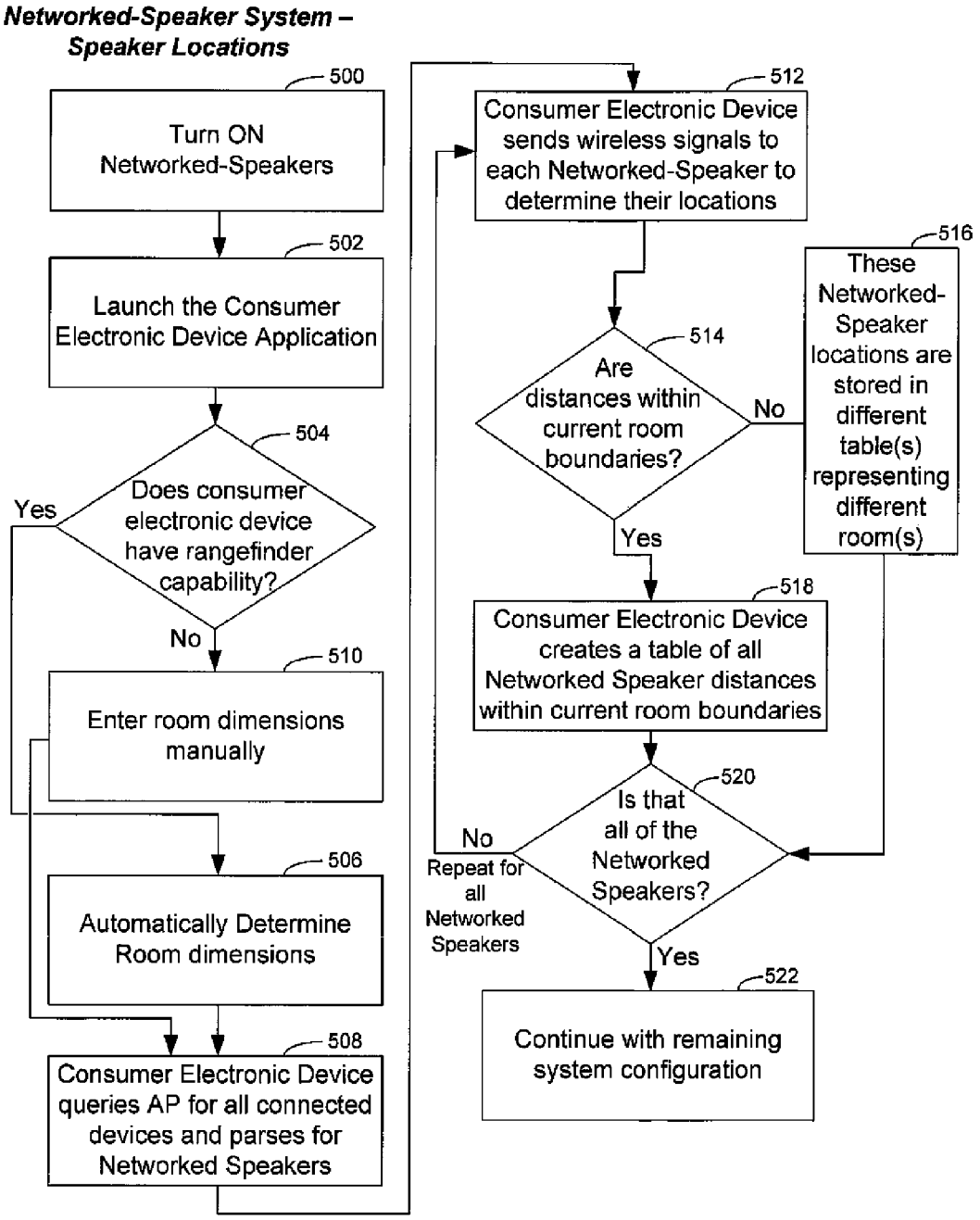

FIG. 2A illustrates supplemental logic in addition to or in lieu of some of the logic disclosed elsewhere herein that may be employed in example non-limiting embodiments to discover and map speaker location and room (enclosure 70) boundaries. Commencing at block 500, the speakers are energized and a discovery application for executing the example logic below is launched on the CE device 12. If the CE device 12 has range finding capability at decision diamond 504, the CE device (assuming it is located in the enclosure) automatically determines the dimensions of the enclosure in which the speakers are located relative to the current location of the CE device 12 as indicated by, e.g., the GPS receiver of the CE device. Thus, not only the contours but the physical locations of the walls of the enclosure are determined. This may be executed by, for example, sending measurement waves (sonic or radio/IR) from an appropriate transceiver on the CE device 12 and detecting returned reflections from the walls of the enclosure, determining the distances between transmitted and received waves to be one half the time between transmission and reception times the speed of the relevant wave. Or, it may be executed using other principles such as imaging the walls and then using image recognition principles to convert the images into an electronic map of the enclosure.

From block 506 the logic moves to block 508, wherein the CE device queries the speakers, e.g., through a local network access point (AP), by querying for all devices on the local network to report their presence and identities, parsing the respondents to retain for present purposes only networked audio speakers. On the other hand, if the CE device does not have rangefinding capability the logic moves to block 510 to prompt the user of the CE device to enter the room dimensions.

From either block 508 or block 510 the logic flows to block 512, wherein the CE device 12 sends, e.g., wirelessly via Bluetooth, Wi-Fi, or other wireless link a command for the speakers to report their locations. These locations may be obtained by each speaker, for example, from a local GPS receiver on the speaker, or a triangulation routine may be coordinated between the speakers and CE device 12 using ultra wide band (UWB) principles. UWB location techniques may be used, e.g., the techniques available from DecaWave of Ireland, to determine the locations of the speakers in the room. Some details of this technique are described in Decawave's USPP 20120120874, incorporated herein by reference. Essentially, UWB tags, in the present case mounted on the individual speaker housings, communicate via UWB with one or more UWB readers, in the present context, mounted on the CE device 12 or on network access points (APs) that in turn communicate with the CE device 12. Other techniques may be used.

The logic moves from block 512 to decision diamond 514, wherein it is determined, for each speaker, whether its location is within the enclosure boundaries determined at block 506. For speakers not located in the enclosure the logic moves to block 516 to store the identity and location of that speaker in a data structure that is separate from the data structure used at block 518 to record the identities and IDs of the speakers determined at decision diamond 514 to be within the enclosure. Each speaker location is determined by looping from decision diamond 520 back to block 512, and when no further speakers remain to be tested, the logic concludes at block 522 by continuing with any remaining system configuration tasks divulged herein.

Figure 3:
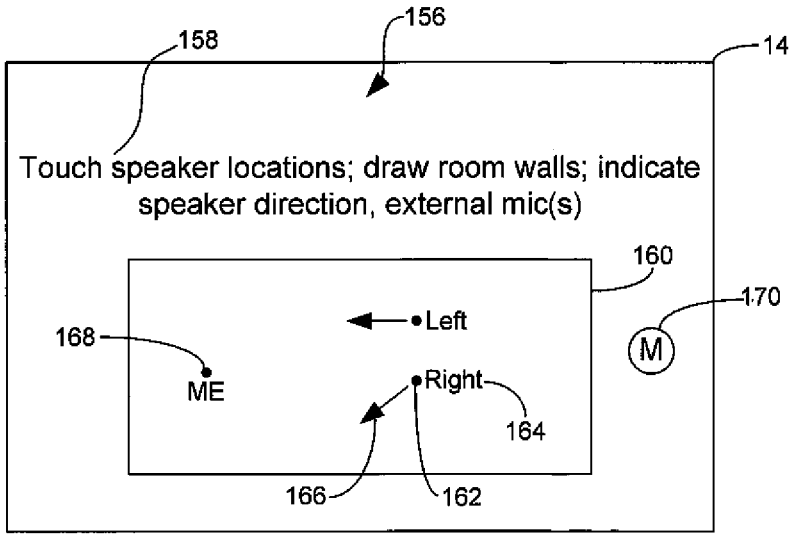
FIG. 3 is an example user interface (UI) according to present principles.

FIG. 3 shows an example UI 156 that may be presented on the CE device 12 according to discussion above. The user is prompted 158 to touch speaker locations and trace as by a finger or stylus the enclosure 70 walls, and further to name speakers and indicate a target listener location. Accordingly, the user has, in the example shown, drawn at 160 the enclosure 70 boundaries and touched at 162 the speaker locations in the enclosure. At 164 the speaker has input speaker names of the respective speakers, in this case also defining the frequency response assignation desired for each speaker. At 166 the user has traced the direction of the sonic axis of each speaker, thereby defining the orientation of the speaker in the enclosure. At 168 the user has touched the location corresponding to a desired target listener location. At 170 the user has indicated the location of the feed-forward external microphone 81. These inputs are then used in the logic of FIG. 2 when executing the various waveform interference-based steps.

A Wi-Fi or network connection to the server 60 from the CE device 12 and/or CPU 50 may be provided to enable updates or acquisition of the control application. The application may be vended or otherwise included or recommended with audio products to aid the user in achieving the best system performance. An application (e.g., via Android, iOS, or URL) can be provided to the customer for use on the CE device 12. The user initiates the application, answers the questions/prompts above, and receives recommendations as a result. Parameters such as EQ and time alignment may be updated automatically via the network.

While the particular WIRELESS SPEAKER SYSTEM WITH NOISE CANCELATION is herein shown and described in detail, it is to be understood that the subject matter which is encompassed by the present invention is limited only by the claims.

What is claimed is:

1. A device comprising:

at least one computer memory that is not a transitory signal and that comprises instructions executable at least one processor for:

receiving a noise signal from at least one microphone;

receiving room information indicating wall configuration of a room in which multiple speakers are located;

receiving speaker location information indicating a location in the room of at least one speaker;

receiving listener location information indicating a target listener location;

based on at least the room information and listener location information, determining an amplitude and phase, at the target listener location, of noise represented by the noise signal at the target listener location; and based on the room information, speaker location information, listener location information, and determination of the amplitude and phase of the noise at the target listener location, causing the at least one speaker to emit a noise cancelation signal calculated to have an amplitude equal to the amplitude of the noise at the target listener location and a phase opposite to the phase of the noise at the target listener location.

2. The device of claim 1, wherein the microphone is external to the room.

3. The device of claim 1, wherein the microphone is at the target listener location.

4. The device of claim 1, wherein the microphone is not at the target listener location.

5. The device of claim 4, wherein the instructions are executable for:

receiving microphone information indicating a location of the microphone; and based on at least the room information, microphone information, and listener location information, determining an amplitude and phase of the noise at the target listener location.

6. The device of claim 1, wherein the instructions are executable for:

receiving the room information indicating configuration of a room in which multiple speakers are located from a user interface (UI).

7. The device of claim 1, wherein the instructions are executable for:

receiving the speaker location information indicating a location in the room of at least one speaker from a user interface (UI).

8. The device of claim 1, wherein the instructions are executable for:

receiving the listener location information indicating a target listener location from a user interface (UI).

9. Method comprising:

receiving a noise signal from at least one microphone;

receiving from a user interface (UI) room information indicating a wall configuration of a room in which multiple speakers are located;

receiving from a UI speaker location information indicating a location in the room of at least one speaker;

receiving from a UI listener location information indicating a target listener location;

based on at least the room information and listener location information, determining noise characteristics at the target listener location; and based on the room information, speaker location information, listener location information, and determination of the noise characteristics at the target listener location, causing the at least one speaker to emit a noise cancelation signal calculated to substantially cancel the noise characteristics.

10. The method of claim 9, wherein the noise characteristics include an amplitude and phase of the noise at the target listener location and the noise cancelation signal is calculated to have an amplitude equal to the amplitude of the noise signal at the target listener location and a phase opposite to the phase of the noise signal at the target listener location.

11. The method of claim 9, wherein the microphone is at the target listener location.

12. The method of claim 9, wherein the microphone is not at the target listener location.

13. The method of claim 9, comprising:

receiving microphone information indicating a location of the microphone; and based on at least the room information, microphone information, and listener location information, determining an amplitude and phase of the noise at the target listener location.

14. System comprising:

at least one computer readable storage medium bearing instructions executable by a processor which is configured for accessing the computer readable storage medium to execute the instructions to configure the processor for:

accessing a networked audio speaker system;

receiving at least a noise signal from a microphone;

receiving room information indicating a wall configuration of a room in which multiple speakers are located; and based on the room information indicating configuration of the room, causing at least one speaker to emit a noise cancelation signal calculated to have sonic characteristics to cause destructive interference with the noise signal at a target listener location.

15. The system of claim 14, wherein the instructions further configure the processor for:

receiving speaker location information indicating a location in the room of at least one speaker;

receiving listener location information indicating a target listener location;

based on at least the room information and listener location information, determining an amplitude and phase, at the target listener location, of noise represented by the noise signal at the target listener location; and based on the room information, speaker location information, listener location information, and determination of the amplitude and phase of the noise at the target listener location, causing the at least one speaker to emit a noise cancelation signal calculated to have an amplitude equal to the amplitude of the noise at the target listener location and a phase opposite to the phase of the noise at the target listener location.

16. The system of claim 15, wherein the microphone is at the target listener location.

17. The system of claim 15, wherein the microphone is not at the target listener location.

18. The system of claim 17, wherein the processor when executing the instructions is configured for:

receiving microphone information indicating a location of the microphone; and based on at least the room information, microphone information, and listener location information, determining an amplitude and phase of the noise at the target listener location.

19. The system of claim 15, wherein the processor when executing the instructions receives the room information indicating configuration of a room in which multiple speakers are located from a user interface (UI).

20. The system of claim 15, wherein the processor when executing the instructions receives the speaker location information indicating a location in the room of at least one speaker from a user interface (UI).

* * * * *